US005335967A

United States Patent [19]

Vanderminden, Sr.

[11] Patent Number: 5,335,967

[45] Date of Patent: Aug. 9, 1994

[54] COLLAPSIBLE CHAIR

[75] Inventor: Robert D. Vanderminden, Sr., Granville, N.Y.

[73] Assignee: Telescope Casual Furniture Co., Granville, N.Y.

[21] Appl. No.: 156,387

[22] Filed: Nov. 22, 1993

Related U.S. Application Data

[63] Continuation of Ser. No. 832,402, Feb. 7, 1992, abandoned.

[51] Int. Cl.[5] ..... A47C 4/00

[52] U.S. Cl. ..... 297/35; 297/359; 297/440.24

[58] Field of Search ..... 297/440.24, 27, 39, 297/35, 449, 28, 359, DIG. 2, 28, 46, 50, 411.26, 411.43, 344.12, 344.18

[56] References Cited

U.S. PATENT DOCUMENTS

| | | | |
|---|---|---|---|
| Re. 20,181 | 11/1936 | Freedman | 297/27 X |
| 2,630,162 | 3/1953 | Rechler | 297/359 X |
| 2,649,138 | 8/1953 | Rechler | 297/39 X |
| 2,708,962 | 5/1955 | Rechler | 297/35 X |
| 3,075,811 | 1/1963 | Brown | 297/359 |
| 3,135,551 | 6/1964 | Andreoli et al. | 297/359 |
| 3,634,894 | 1/1972 | Harbison | 297/DIG. 2 X |
| 4,072,341 | 2/1978 | Kurz | 297/27 |
| 4,674,793 | 6/1987 | Kettler | 297/359 X |
| 4,778,216 | 10/1988 | Stupakis | 297/345 X |
| 4,867,505 | 9/1989 | Parker | 297/27 |

FOREIGN PATENT DOCUMENTS

| | | | |
|---|---|---|---|
| 0491580 | 3/1953 | Canada | 297/39 |
| 2037066 | 7/1970 | Fed. Rep. of Germany | 297/27 |
| 3707804 | 9/1988 | Fed. Rep. of Germany | 297/359 |
| 2593050 | 7/1987 | France | 297/359 |
| 0815024 | 6/1959 | United Kingdom | 297/39 |

*Primary Examiner*—Kenneth J. Dorner
*Assistant Examiner*—Milton Nelson, Jr.
*Attorney, Agent, or Firm*—Francis C. Hand

[57] ABSTRACT

The collapsible sand chair is constructed with a front leg support frame, a back leg support frame, a back rest and a pair of arms. The back leg support frame includes a pair of extendable legs which are articulated via U-shaped brackets to the legs of the front leg support frame. Each extendable leg includes a hollow tube and a plastic slider which is able to be pulled out of the hollow tube when the chair is collapsed into a folded position. The back rest can be unfolded into an upright position, a fully reclined position and intermediate positions therebetween by moving the arms relative to the U-shaped brackets articulating the leg support frames together.

14 Claims, 3 Drawing Sheets 10
11
12
13
14
15
16
17
18
19
20
21
22
23
24
25
29
30
31
32
33
34

5
5
12
13
21
22
24
25
26
27
28
33
35
36
37
38
39

COLLAPSIBLE CHAIR

This is a continuation of application Ser. No. 07/832,402 filed on Feb. 7, 1992 and now abandoned.

invention relates to a collapsible chair. More particularly, this invention relates to a collapsible sand chair.

Heretofore, various types of collapsible chairs have been known for various types of casual use. For example, collapsible chairs have been known which can be readily carried in a collapsed state and easily unfolded to permit an occupant to be seated on sand, for example, on a beach. In many cases, these collapsible chairs have been constructed so as to be unfolded not only from a collapsed position into an upright position so as to permit an occupant to be seated in a comfortable position, but also to be articulated into a reclining position so as to permit an occupant to recline, for example as described in U.S. Pat. No. 4,514,009.

In the past, the chairs which have been capable of being unfolded into upright and reclining positions have employed various types of hinge connections between the various components of the chair in order to permit unfolding into the desired position of use.

It is an object of this invention to provide a sand chair of inexpensive construction which can be manipulated into a collapsed position as well as upright and reclined position.

It is another object of the invention to simplify the construction of a collapsible chair to permit unfolding of the chair into various positions.

Briefly, the invention provides a collapsible chair which is comprised of a seat, a front leg support frame pivotally connected to the seat and a back leg support frame pivotally connected to the seat and including a pair of extendable legs articulated to the front leg support frame to permit pivoting of the front leg support frame relative to the back leg support frame.

The chair is constructed so as to be folded into a collapsed position and to be unfolded into several opened positions. In this respect, the backrest is movable relative to the seat between a collapsed position, for example, for transportation or storage purposes, a raised position to permit an occupant to be seated and a reclining position extending from the seat to permit an occupant to take up a reclined position.

The back leg support frame is constructed so that each extendable leg includes a hollow tube connected to the seat and the back rest while a slider is slidably mounted in the hollow tube in telescoping relation and connected to the front leg support frame. The slider may be in the form of a hollow plastic tube of relatively inexpensive material.

The back rest may be constructed with a frame having an outwardly extending portion for forming a leg support when the back rest is in the reclining position.

The chair is constructed with a pair of joint means, each of which is pivotally connected to the front leg support frame and fixedly secured to an extendable leg of the back leg support frame. In order to secure the chair in a given position of use, each arm of the chair is provided with a fixed guide bar which is slidably mounted in a respective joint means in order to articulate the arm to each leg support frame. In addition, each arm may be provided with a series of longitudinally spaced recesses for selectively receiving a respective joint means therein in order to establish a releasable position of the back rest relative to the seat. In this respect, each joint means may be in the form of a U-shaped plate having a shaped portion for fitting into a respective recess of a respective arm.

In use, the chair may be collapsed into a collapsed position which permits the chair to be carried or otherwise transported or stored in a relatively compact manner. In this positio, the sliders of the extendable legs are in a position extended from the respective hollow tubes of the extendable legs. In order to unfold the chair into, for example, an upright position, the arms are separated to a slight extent from the joint means articulated to the two leg support frames and the back rest is pivoted away from the seat into the upright position. During this time, the sliders telescope into the hollow tubes of the extendable legs. Thereafter, the arms can be engaged with the joint means via the recesses in the arms. The chair will then stay in the upright position. Should an occupant desire to move the chair into the reclining position, the arms are again separated from the joint means while the occupant remains seated and the back rest pivoted further into a reclining position substantially parallel to the seat. At this time, the arms can be re-engaged with the joint mean via the recesses in the arms. The chair will then be retained in this reclining position.

In order to collapse the chair, a reverse procedure to that described above is followed.

These and other objects and advantages of the invention will become more apparent from the following detailed description taken in conjunction with the accompany drawings wherein.

Figure 1:
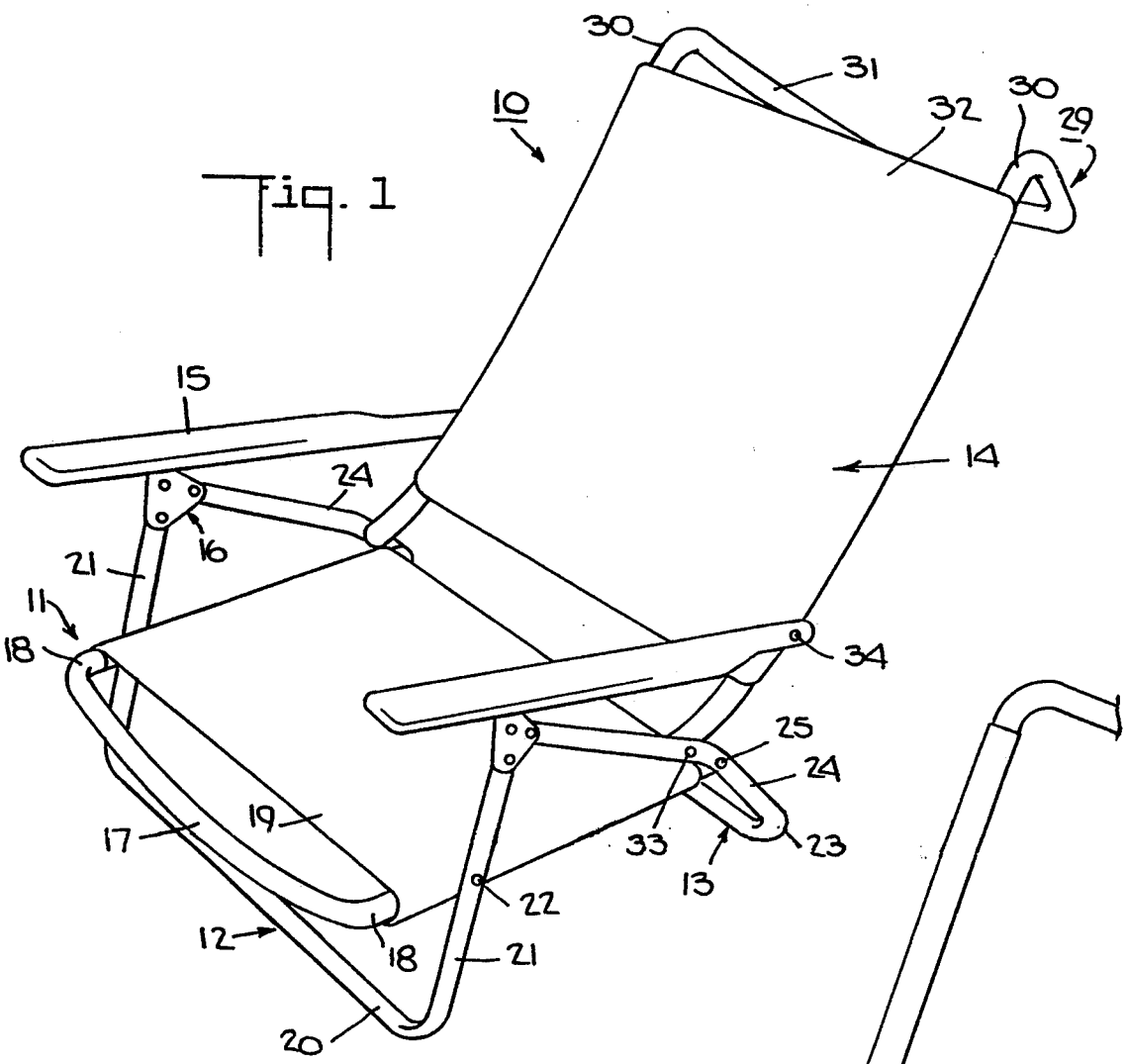
FIG. 1 illustrates a perspective view of a collapsible chair constructed in accordance with the invention.

Referring to FIG. 1, the collapsible chair includes a seat 11, a front leg support frame 12, a back leg support frame 13, a back rest 14, and a pair of arms 15. In addition, the chair includes a pair of joint means 16, each of which is secured to and between the front leg support frame 12 and back leg support frame 13 in an articulated manner.

The seat 11 is formed of a U-shaped frame 17, for example a hollow aluminum tubing, having a pair of legs 18 and a strip of fabric 19 which is secured to the legs 18 and extends across the frame 17. The strip of fabric 19 may be secured to the legs 18 of the frame in any suitable manner and need not be further described.

The front leg support frame 12 is constructed of a U-shaped frame 20, for example of hollow aluminum tubing, having a pair of upstanding legs 21. As indicated, each leg 21 is pivotally secured as by a pin or rivet 22 to a leg 18 of the U-shaped frame 17 of the seat 11.

The back leg support frame 13 is formed of a U-shaped frame 23, for example of hollow aluminum tubing and includes a pair of bent extendable legs 24 as indicated. Each leg 24 is pivotally connected as by a pin or rivet 25 to a leg 18 of the frame 17 of the seat 11.

Figure 2:
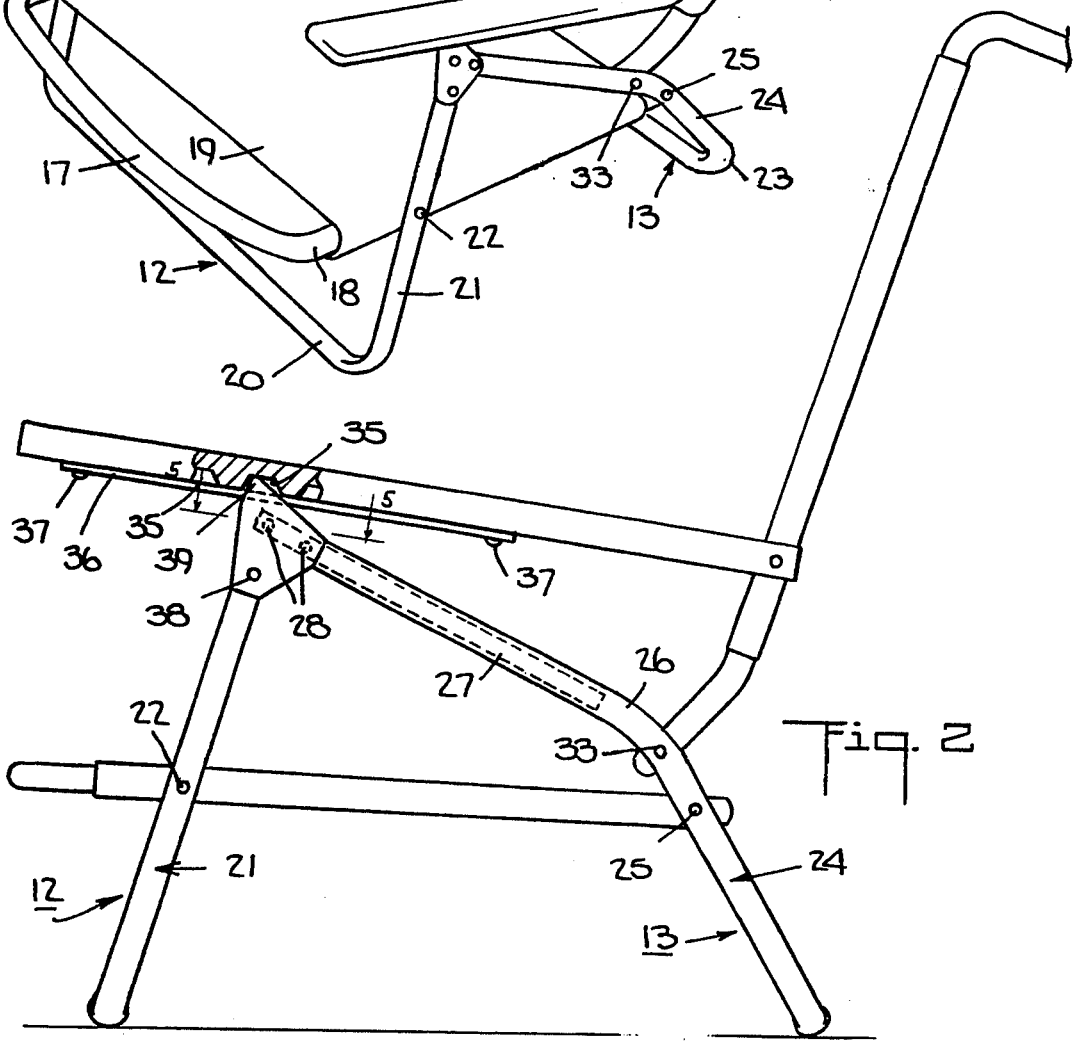
FIG. 2 illustrates the chair of FIG. 1 in an upright position in accordance with the invention.

Referring to FIG. 2, each extendable leg 24 of the back leg support frame 13 includes a hollow tube 26 connected to the seat 11 and a slider 27, for example in the form of a hollow plastic tube, which is slidably mounted in the hollow tube 26 in telescoping relation. The slider 27 is further connected in fixed relation to a joint means 16, for example by means of a pair of pins 28.

The back rest 14 is formed of a U-shaped frame 29, for example of hollow aluminum tubing, having a pair of legs 30 and an outwardly extending portion 31 for forming a leg support with the chair 10 in a reclining position as described hereinafter. In addition, the back rest 14 includes a strip of fabric 32 or the like, which is secured to and across the legs 30 of the back rest 14 in known manner.

Referring to FIG. 2, each leg 30 of the back rest 14 is pivotally connected via a pin 33 or the like to a respective leg 24 of the back leg support frame 13.

Each arm 15 is pivotally connected via a pivot pin 34 or the like to a leg 30 of the back rest 14, for example, within the lower one-third of the leg 30 as viewed in FIG. 2. Each arm 15 is made, for example of wood and is provided with a suitable weather resistant surface or coating. In addition, each arm 15 has a series of spaced recesses 35, for example four for selectively receiving a respective joint means 16 in order to establish a releasable position of the back rest 14 relative to the seat 11.

Referring to FIG. 2, each arm 15 carries a guide bar 36 which is secured on an underside by screws 37 or other type fastener at opposite ends. Each guide bar 36 extends over the series of recesses 35 and is slidably mounted in a joint means 16 in order to articulate the arm 15 to the leg support frames 12, 13.

Figure 5:
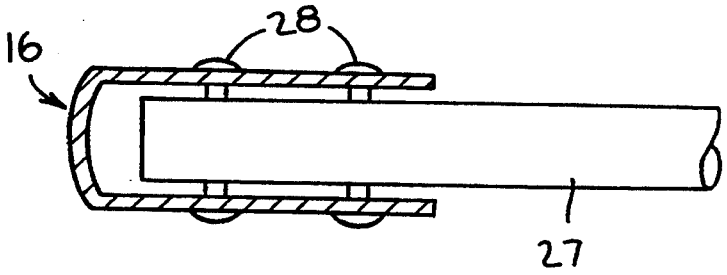
FIG. 5 illustrates a view taken on line 5—5 of FIG. 2.

As also shown in FIG. 2, each joint means 16 is pivotally connected to a leg 21 of the front leg support frame 12 by a pivot pin 38 so as to permit relative pivoting therebetween. In addition, each joint means 16 is in the form of a U-shaped plate, as viewed from above (see FIG. 5), having an upper shaped portion 39 for fitting into a respective recess 35 of an arm 15. Further, this upper portion 39 is provided with an enlarged slot (not shown) so as to slidably receive the guide bar 36.

As illustrated in FIGS. 1 and 2, the chair 10 is in an upright manner as so to receive an occupant in a seated position. In this condition, each joint means 16 projects into a recess 35 of a respective arm 15 so as to retain the chair in the illustrated position.

In order to adjust the position of the back rest 14, for example while an occupant is seated on the seat 11, the two arms 15 are raised, that is, pivoted in a clockwise manner as viewed in FIG. 2 so as to lift the arms 15 away from the joint means 16. To this end, the underside of each arm 15 may be provided with a longitudinal groove so as to permit the upper portion 39 of each joint means 16 to be moved out of a recess 35 and slid relative to the guide bar 36 into another recess 35 along the length of the guide bar 36. Alternatively, each guide bar 36 may have an intermediate portion spaced from the underside of the arm 15 so as to permit the upper slider portion 39 of a joint means 16 to slide along the guide bar 36 from one recess 35 to another recess 35.

In order to unfold the chair into a fully reclined position, for example with the occupant still seated so that the back rest 15 extends from the seat 11, the arms 15 are raised relative to the joint means 16 and moved rearwardly relative to the joint means 16 until the upper end 39 of each joint means is adjacent the foremost recess 35 of a respective arm. During this time, the back rest 14 pivots via the pivot pins 30 on the back leg support frame 13 until the outwardly extending portion 31 abuts a ground surface G (see FIG. 3). During this time, each arm 15 pivots relative to the back rest 14 via the pivot pins 34.

Figure 3:
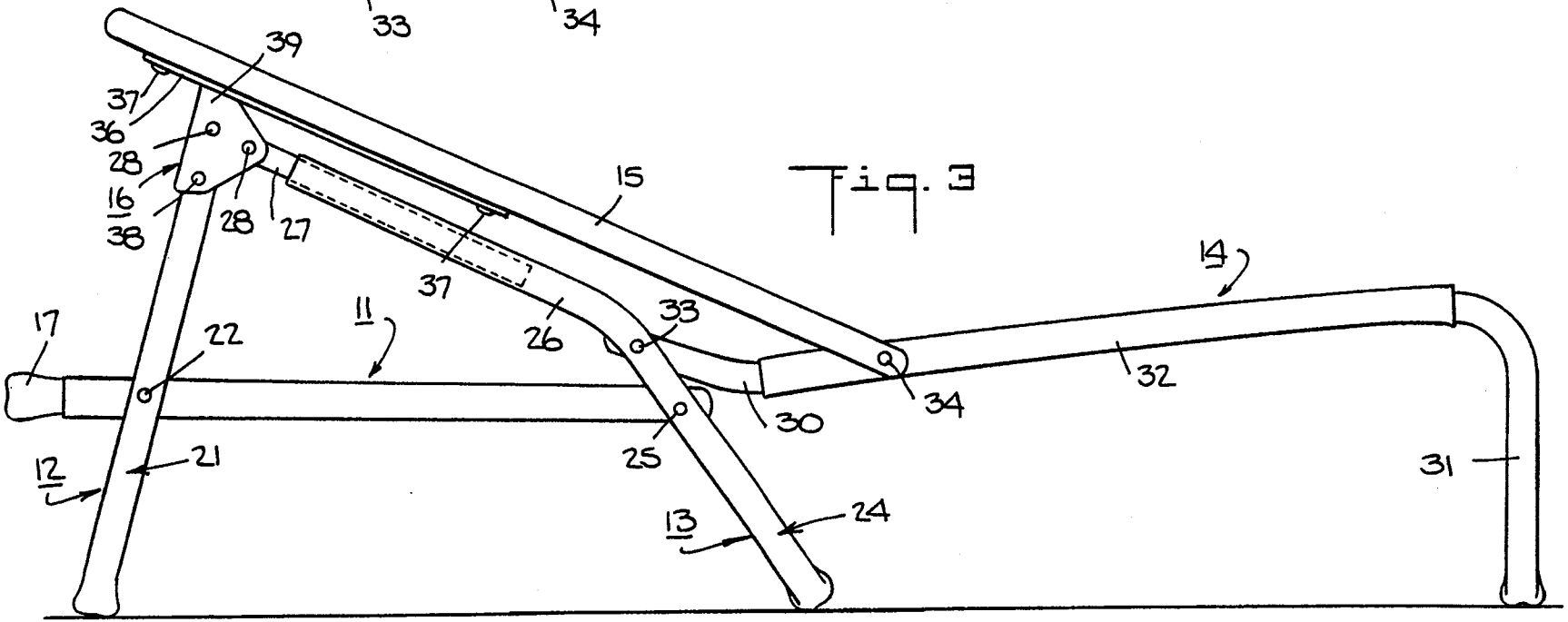
FIG. 3 illustrates a side view of the chair of FIG. 1 in a reclining position in accordance with the invention.

In order to place the back rest 14 in a locked and fully reclined position as shown in FIG. 3, the front leg support frame 12 is pivoted relative to the seat 11, for example in a counter-clockwise direction, as viewed in FIGS. 2 and 3, while the arms 15 are raised relative to the joint means 16. This allows the respective plastic slider tube 36 to extend a small distance outwardly from the respective hollow leg 35 of the back leg support frame 13, for example, into a position as shown in FIG. 3 to allow each joint means 16 to be inserted into the foremost recess 32 of the arm 15. This position corresponds to the reclined position shown in FIG. 3, that is, the position in which the outwardly extending portion 28 of the back rest 14 is resting on the ground surface G. During this time, the front leg support frame 12 pivots slightly relative to the respective joint means 16.

Figure 4:
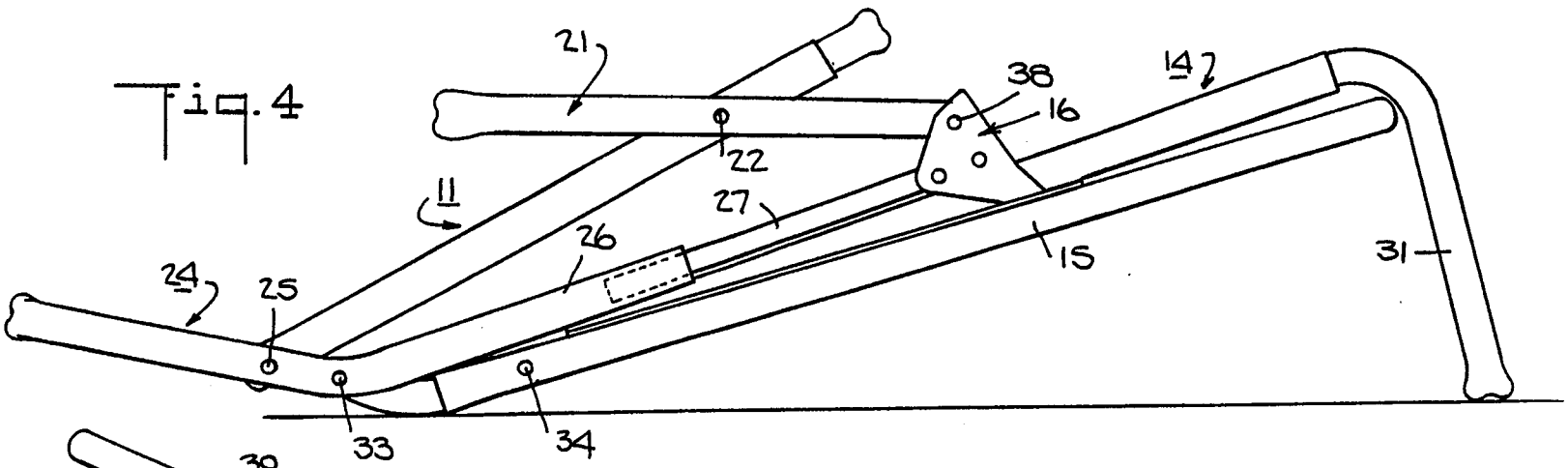
FIG. 4 illustrates a side view of the chair of FIG. 1 in a collapsed position in accordance with the invention.

Referring to FIG. 4, in order to collapse the chair 10 into a fully collapsed or folded position, the arms 15 are raised relative to the joint means 16 so as to permit relative movement therebetween. The back rest 14 is then pivoted in a counter-clockwise direction, as viewed in FIG. 2, so as to move below the plane of the arms 15, that is into a position located between the plane of the arms 15 and the plane of the seat 11.

As the back rest 14 pivots on the pivot pins 30 of the back leg support frame 13, the slider tubes 27 of the back leg support frame 13 telescope outwardly into extended positions relative to the hollow tubes 35 as indicated in FIG. 4. In addition, the front leg support frame 12 pivots counter-clockwise about the pivot pins 22 while also pivoting relative to the respective joint means 16 via the pins 38.

As the back rest 14 pivots in a counter-clockwise manner on the pins 30 of the back leg support frame 13, the respective joint means 16 slides rearwardly along the respective guide bar 36 until reaching a rearmost position (which may or may not have a corresponding recess 35 thereat). From this point onwards, the continued pivoting of the back rest 14 causes the joint means 16 to move with the arms 15 and back rest 14 so as to extend the legs 24 of the back leg support frame 13, that is, to pull the sliders 27 from the hollow tubes 26 into the position shown in FIG. 4.

When the chair 10 is in the collapsed position shown in FIG. 4, the chair can be readily carried from place to place.

The invention thus provides a chair which can be readily used, for example, as a sand chair on a beach front or by pool side.

Further, the invention provides a sand chair which has a limited number of parts to permit unfolding into an upright position or in a fully reclined position.

Further, the invention further provides a sand chair which can be made in an economical manner.

What is claimed is:

1. A collapsible chair comprising a seat;

a front leg support frame pivotally connected to said seat;

a back leg support frame pivotally connected to said seat, said back leg support frame including a pair of telescopically extendable legs articulated to said front leg support frame to permit pivoting of said front leg support frame relative to said back leg support frame;

a backrest pivotally mounted on said back leg support frame; and a pair of arms, each arm being pivotally connected to said backrest and releasably connected to said back leg support frame.

2. A collapsible chair as set forth in claim 1 wherein each extendable leg includes a hollow tube connected to said seat and said backrest and a slider slidably mounted in said hollow tube in telescoping relation and connected to said front leg support frame.

3. A collapsible chair as set forth in claim 2 wherein said slider is a plastic tube.

4. A collapsible chair as set forth in claim 1 wherein said backrest is movable relative to said seat between a collapsed position, a raised position and a reclining position extending from said seat.

5. A collapsible chair as set forth in claim 4 wherein said backrest includes a frame having an outwardly extending portion for forming a leg support in said reclining position of said backrest.

6. A collapsible chair comprising a seat;

a front leg support frame pivotally connected to said seat;

a back leg support frame pivotally connected to said seat and including a pair of telescopically extendable legs;

a pair of joint means, each joint means being pivotally connected to said front leg support frame and fixedly secured to a respective extendable leg of back leg support frame;

a backrest pivotally mounted on said extendable legs of said back leg support frame; and a pair of arms, each arm being pivotally connected to said backrest and releasably connected to a respective joint means.

7. A collapsible chair as set forth in claim 6 wherein each arm has a series of spaced recesses for selectively receiving a respective joint means to establish a releasable position of said backrest relative to said seat and wherein each joint means is a U-shaped plate having a shaped portion for fitting into a selected recess of a respective arm.

8. A collapsible chair as set forth in claim 6 which further comprises a guide bar secured to a respective arm and slidably mounted in a respective joint means to articulate said respective arm to each said leg support frame.

9. A collapsible chair as set forth in claim 8 wherein each arm has a series of longitudinally spaced recesses for selectively receiving a respective joint means therein to establish a releasable position of said backrest relative to said seat.

10. A collapsible chair as set forth in claim 9 wherein each extendable leg includes a hollow tube connected to said seat and said backrest and a slider slidably mounted in said hollow tube in telescoping relation.

11. A collapsible chair as set forth in claim 9 wherein said backrest is movable relative to said seat between a collapsed position, a raised position and a reclining position extending from said seat.

12. A collapsible chair as set forth in claim 11 wherein said backrest includes a frame having an outwardly extending portion for forming a leg support in said reclining position of said backrest.

13. A collapsible chair comprising a seat including a U-shaped frame having a pair of legs;

a front leg support frame having a U-shaped frame pivotally connected to said legs of said seat;

A back leg support frame having a U-shaped frame pivotally connected to said legs of said seat and including a pair of extendable legs;

A pair of joint means, each joint means being pivotally connected to said front leg support frame and fixedly secured to a respective extendable leg of said back leg support frame;

a backrest having a U-shaped frame pivotally mounted on said extendable legs of said back leg support frame; and a pair of arms, each arm being pivotally connected to said backrest and releaseably connected to a respective joint means.

14. A collapsible chair as set forth in claim 13 wherein said backrest is movable relative to said seat between a collapsed position, a raised position and a reclining position extending from said seat.

* * * * *